United States Patent [19]

Gridley

[11] Patent Number: 4,917,337

[45] Date of Patent: Apr. 17, 1990

[54] ARTICLE SUPPORT FOR PEGBOARDS OF ALTERNATE THICKNESS

[76] Inventor: John W. Gridley, 5901 Laurel Ave., Golden Valley, Minn. 55416

[21] Appl. No.: 762,064

[22] Filed: Aug. 2, 1985

[51] Int. Cl.[4] ..... A47F 5/00

[52] U.S. Cl. ..... 248/221.2; 248/222.2

[58] Field of Search ..... 248/221.1, 221.2, 220.4, 248/DIG. 11, 222.2, 220.3; 108/108

[56] References Cited

U.S. PATENT DOCUMENTS

| | | | |
|---|---|---|---|
| 3,163,392 | 12/1964 | Husted | 248/221.2 |
| 3,401,909 | 9/1968 | Kalahar | 248/221.2 |
| 3,625,464 | 12/1971 | Conran | 248/223 |
| 3,664,625 | 5/1972 | Price | 248/223 |
| 3,672,621 | 6/1972 | Bambenek | 248/220.4 |
| 3,891,172 | 6/1975 | Einhorn | 248/221.2 |
| 3,897,926 | 8/1975 | Silver | 248/221.2 |
| 4,008,873 | 2/1977 | Travaglio et al. | 108/108 X |
| 4,204,480 | 5/1980 | Hanna | 108/108 |
| 4,405,110 | 9/1983 | Gibbons | 248/221.2 |

*Primary Examiner*—David M. Purol

*Attorney, Agent, or Firm*—Schroeder & Siegfried

[57] ABSTRACT

An article support for use with pegboards of two different thicknesses and two different size holes, both with the same spacing between holes is disclosed in which an upper hook element has a curved end member for extending through a hole in the pegboard and has a lower locking element extending through another pegboard hole, both elements having bosses forming a portion thereof and extending normally from a base member joining said upper hook and lower locking elements to either lie against the pegboard or spacially therefrom.

5 Claims, 1 Drawing Sheet

ARTICLE SUPPORT FOR PEGBOARDS OF ALTERNATE THICKNESS

This is a continuation of application Ser. No. 06/461,592, filed Jan. 27, 1983 now abandoned.

BACKGROUND OF THE INVENTION

This invention relates to the field of an article support for a pegboard and particularly for pegboards of two different sizes having two different size holes in the pegboard.

It is common knowledge that pegboards generally are made in two different sizes, one of which is approximately ⅛" in thickness wherein holes having a 3/16" diameter are formed on 1" centers, both vertically and horizontally. Another pegboard may be in use that is ¼" thick using ¼" holes but are also on 1" centers, both horizontally and vertically. That is, both boards are formed to utilize pegboard supports or hooks, and they are generally formed in two different sizes. Generally, one set will be used with the ⅛" board and 3/16" holes and another set of hooks will be used with the ¼" thick board and ¼" holes.

There have been obvious attempts to produce a pegboard hook which may be used in either pegboard without paying any apparent attention to the particular style. Most of the hooks (refers to any style of holder secured to a pegboard) are made so that they are formed from wire ⅛" in diameter and have a projection welded to the rear portion of the hook member that will either either fit into the ⅛" board or the ¼" board. In either instance, there is no latch or projection member that engages the edge of the hole so that the hook will generally be held in place and not be removable unless some force is applied to the hook to remove the same. For example, U.S. Pat. No. 3,664,625, makes use of a mechanism just described in which there is nothing that prevents the hook from being drawn forwardly away from the board and thus causing the hook to become loose. Additionally, the upper end of the hook member does not have any means of materially holding it in place other than through the use of a small notch formed in the edge of the wire member.

Another U.S. Pat. No. 3,625,464, makes use of an arrangement similar to that shown in the Price U.S. Pat. No. 3,664,625, where there is nothing to support the upper end of the hook. In order to secure in a pegboard hole, serrations are formed around the periphery of the stud member and are used to secure the hook in place.

Neither of the above referenced devices impose any latch member in engagement with the pegboard holder to secure the hook in place.

It is therefore a general object of this invention to provide an article support for use with a pegboard having a thickness of one of two different thicknesses.

It is still another object of this invention to provide an article support for use with a pegboard having holes formed therein of one of two different sizes.

It is yet another object of this invention to provide bosses of generally cylindrical shape to work within the holes of the thickest pegboard.

It is yet a further object of this invention to provide bosses of generally cylindrical shape to work with the upper hook and lower locking elements to secure the article support member against slippage when used with a pegboard having the smallest thickness and smallest size holes.

It is still another object of this invention to provide an article support that locks firmly into place on the pegboard.

It is yet another object of this invention to provide a holder for a pegboard of different thicknesses that will not fall from the pegboard when a tool or other item is removed for use.

BRIEF DESCRIPTION OF THE DRAWINGS

A detailed description of one preferred embodiment of the ARTICLE SUPPORT FOR PEGBOARDS OF ALTERNATE THICKNESS is hereafter described with specific reference being made to the drawings in which.

Figure 1:
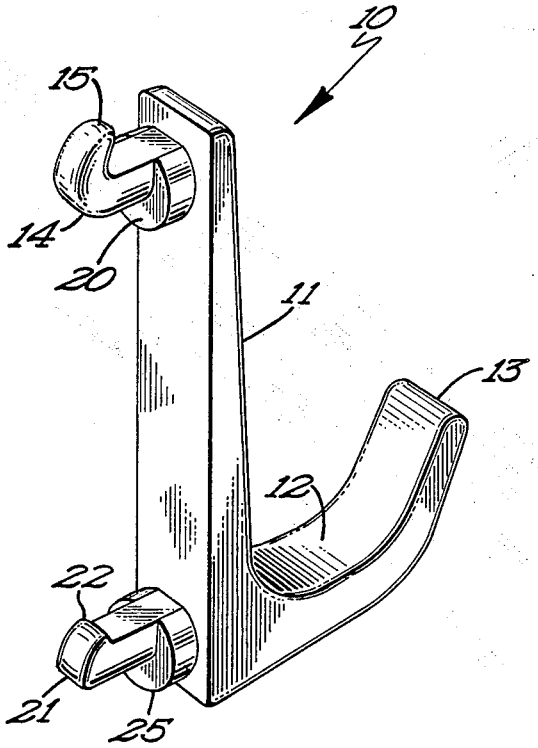
FIG. 1 is a perspective view of the invention.
Figure 2:
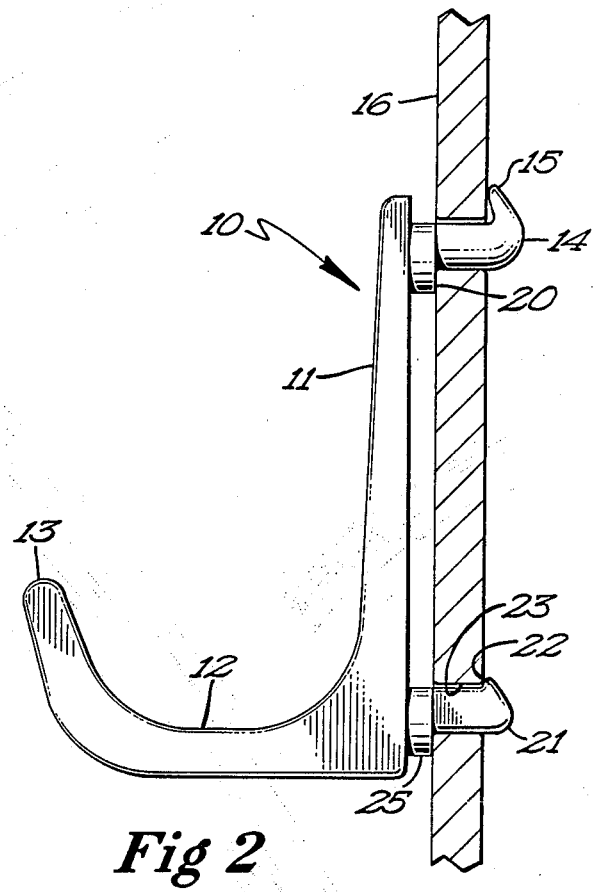
FIG. 2 is a side elevation of an article support member secured in a small thickness pegboard.
Figure 4:
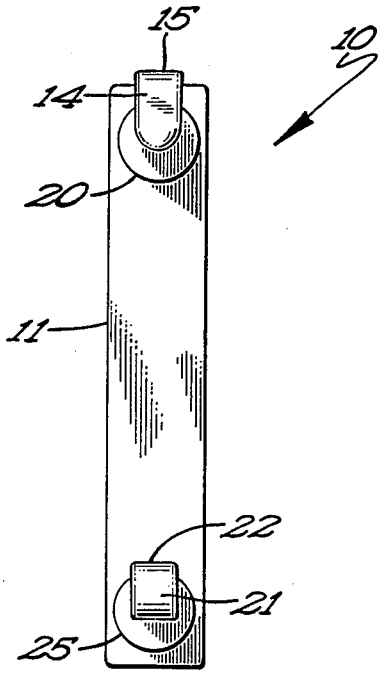
FIG. 4 is an end elevation view of the invention.
Figure 3:
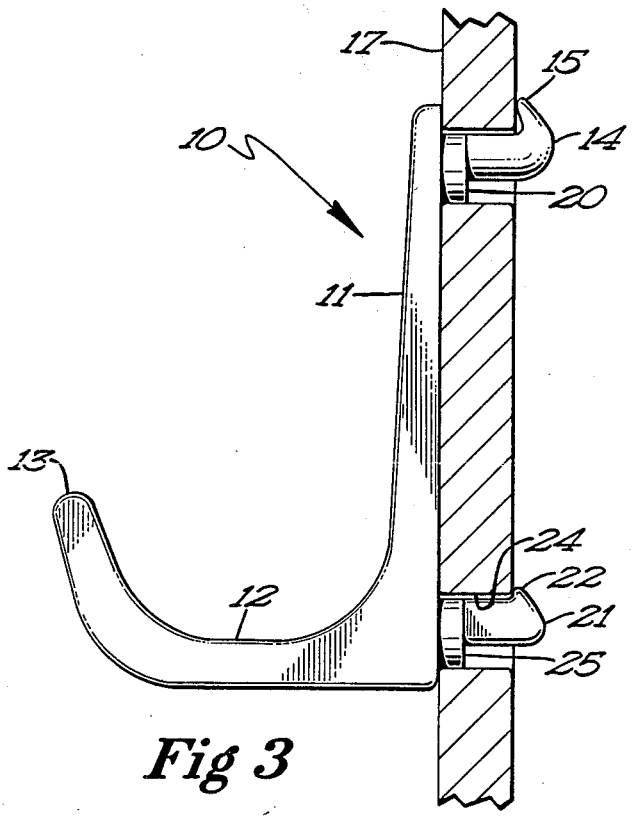
FIG. 3 is a view similar to FIG. 2 in a thick pegboard member.

A hook element 10 is formed with a base member 11 that generally lies flush with or parallel with the face of the pegboard. The lower end of hook 10 includes an article bearing portion 12 and a tip end 13 is turned upwardly to prevent the tool from sliding off the support member. The hooks may be formed from suitable material such as nylon or other readily deformable plastic materials.

Extending from base member 11 at the upper end is a hook element 14 that has a rearwardly extending curved end member that curves back towards base 11 and terminates in a tip 15 that bears against either a thin ⅛" thick pegboard 16, or a thicker ¼" pegboard 17. Implementing upper hook element 14, is an upper boss 20 that forms a portion of upper hook member 14 and extends normally from base member rearwardly. The upper portion of the cylindrical segment is formed so that the upper edge of hook element 14 and boss 20 are coplanar.

A lower locking element 21 is formed extending rearwardly from base member 11 and has an upper portion thereof forming a latch member 22 that engages the edge of pegboards 16 or 17 at the edge of a hole 23 formed in pegboard 16 or hole 24 formed in pegboard 17. The latch member engages the pegboard in such a manner that upon pulling of the article support, or hook 11, the lower locking element 21 will flex an appropriate amount so that the element may be withdrawn from the hole formed in the appropriate pegboard.

A lower boss member 25 is formed integrally with lower locking member 21 in which the upper portion of the boss 25 that is formed generally like a segment of a cylinder, is formed in a flat condition and extends rearwardly along a plane at the upper surface of the lower locking element 21. Thus, where the ⅛" pegboard 16 is used, bosses 20 and 25 bear against the pegboard 16 and upon the upper hook element 14 and lower locking element 21 becoming engaged, the article support member 10 is secured against the pegboard, not only against movement but is effectively locked into place and must be pulled outwardly to be removed from the pegboard.

In a similar manner, when the thicker pegboard 17 is used, bosses 20 and 25, both being circular in nature, slide into the bores formed in the pegboard and the article support 11 is secured to the board in the same manner as just previously described. Both the upper and lower bosses 20 and 25 extend outwardly on three sides from the upper hook element 14 and the lower locking element 21. Instead of bosses 20 and 25 being disposed on the outer face of the pegboard, they form a steadying means for holding the article support member in place. It will also be observed that the base member 11 is generally formed of material having a greater width than the hole diameter of the thickest pegboard 17 so that a proper bearing surface will be presented to the pegboard.

In considering the invention, it should be remembered that the present disclosure is illustrative only and the scope of the invention should be determined by the appended claims.

What is claimed is:

1. An article support for use with perforated boards of different thicknesses having a plurality of equally spaced holes, said article support comprising:

(a) an upper hook element having a reverse curve end member adapted to extend substantially directly to the rear through an opening in a perforated board and terminating in a tip lying adjacent said perforated board;

(b) a base member extending normally from said upper hook element and terminating generally in an article support portion;

(c) an upper boss forming a portion of said upper hook and extending normally from said base member, said boss extending outwardly on three sides from said upper hook element;

(d) a lower locking element having a rearwardly extending abutment member adapted for engagement with at least one portion of a hole in the perforated board;

(e) a lower boss forming a portion of said lower locking element and extending normally from said base member, said boss extending outwardly on three sides from said lower locking element, said upper and lower bosses forming a steadying means for holding said article support member in place; and (f) upon said upper hook element, and said abutment member of said lower locking element being adapted for engagement with the perforated board, said base member is disposed to either lie against the perforated board or spatially disposed therefrom an amount equal to the normal dimensions of said upper and lower bosses.

2. The structure set forth in claim 1 wherein said upper and lower bosses are formed in the shape of a partial cylindrical segment and fit within the holes of the thickest pegboard.

3. The structure set forth in claim 2 wherein said upper and lower bosses conform generally to the cross section of the holes formed in the thickest of said pegboards.

4. The structure set forth in claim 1 wherein said upper and lower bosses, while extending outwardly on three sides are adapted to fit within the larger diameter holes in the perforated board.

5. The structure set forth in claim 1 wherein said upper and lower bosses, while extending outwardly on three sides are adapted to extend over the smaller diameter holes in the perforated board.

* * * * *